US005855241A

United States Patent [19]

Aubry

[11] Patent Number: 5,855,241

[45] Date of Patent: Jan. 5, 1999

[54] COMPACT HEAT EXCHANGER

[75] Inventor: Jean Aubry, Le Plessis Robinson, France

[73] Assignee: GEC Alsthom Stein Industrie, Velizy-Villacoublay, France

[21] Appl. No.: 45,534

[22] Filed: Mar. 23, 1998

[30] Foreign Application Priority Data

Mar. 24, 1997 [FR] France ..... 97 03540

[51] Int. Cl.[6] ..... F28D 13/00

[52] U.S. Cl. ..... 165/104.16; 165/163; 165/162; 165/145; 422/146

[58] Field of Search ..... 165/104.16, 910, 165/163, 162, 145; 422/146

[56] References Cited

U.S. PATENT DOCUMENTS

| | | | |
|---|---|---|---|
| 1,884,778 | 10/1932 | Lucke et al. | 165/145 |
| 2,852,545 | 9/1958 | Jenny | 165/104.16 X |
| 3,530,835 | 9/1970 | Von Wiesenthal | 422/146 |
| 4,167,157 | 9/1979 | Zielinski et al. | 165/104.16 X |
| 4,359,448 | 11/1982 | Schuurman et al. | 165/104.16 X |
| 5,253,703 | 10/1993 | Master et al. | 165/163 X |
| 5,482,110 | 1/1996 | Hartermann et al. | 165/145 X |
| 5,553,897 | 9/1996 | Maillot | 165/104.16 X |

FOREIGN PATENT DOCUMENTS

| | | |
|---|---|---|
| 0064092 A1 | 11/1982 | European Pat. Off. . |
| 0153214 A1 | 8/1985 | European Pat. Off. . |
| WO9117388 | 11/1991 | WIPO . |

*Primary Examiner*—Ira S. Lazarus
*Assistant Examiner*—Christopher Atkinson
*Attorney, Agent, or Firm*—Sughrue, Mion, Zinn, Macpeak & Seas, PLLC

[57] ABSTRACT

The heat exchanger comprises at least one first sheet tubes and at least one second sheet of tubes, the sheets being suspended in a case. The two sheets are juxtaposed in a vertical plane, the first sheet of tubes connecting a first inlet fluid manifold disposed at the bottom and on one side of a case to an outlet manifold disposed in a central top portion of the case, and the second sheet of tubes connecting a second inlet fluid manifold disposed at the bottom and on one side of the case to the outlet manifold. Each sheet comprises first tubes which extend horizontally in the bottom portion of the case, second tubes which are connected to the first tubes and which extend vertically between the bottom portion of the case and the middle portion of the case, and bent third tubes which are connected to the second tubes and which extend between the middle portion of the case and the top portion of the case. This configuration makes it possible to obtain a large heat exchange area with a compact heat exchanger. The heat exchanger is designed to be installed in an external dense bed equipping a circulating fluidized bed hearth.

3 Claims, 1 Drawing Sheet

COMPACT HEAT EXCHANGER

The invention relates to a heat exchanger designed in particular to be installed in an external dense fluidized bed equipping a circulating fluidized bed hearth.

BACKGROUND OF THE INVENTION

Such a heat exchanger conventionally comprises an inlet fluid manifold and an outlet fluid manifold, the manifolds being interconnected by at least one group of tubes extending in zigzag manner in a vertical plane between the inlet manifold and the outlet manifold. The zigzags define hairpins having adjacent branches which slope relative to one another (at an angle approximately in the range 8° to 15°) while leaving empty space between them. The slope is necessary to enable bubbles of fluid vapor to flow naturally in the tubes.

High-power installations require relatively large heat exchange areas. Obtaining such areas involves providing a greater number of heat exchangers or providing a heat exchanger that is large in size and whose design is dictated by the cross flow of the solids.

OBJECTS AND SUMMARY OF THE INVENTION

An object of the invention is to provide a heat exchanger that is compact, i.e. a heat exchanger having dimensions analogous to those of a heat exchanger of the zigzag-tube type, but that offers a larger heat exchange area.

To this end, the invention provides a heat exchanger for a dense fluidized bed, said heat exchanger comprising at least one first group of tubes extending in a vertical plane and forming a first sheet of tubes for connecting a first inlet fluid manifold disposed at the bottom and on one side of a case to an outlet manifold disposed in a central top portion of the case, and at least one second group of tubes extending in said vertical plane and forming a second sheet of tubes for connecting a second inlet fluid manifold disposed at the bottom and on one side of the case to the outlet manifold, wherein each of the first and second sheets of tubes comprises first tubes which extend substantially horizontally and parallel to one another in the bottom portion of the case, second tubes which are connected via multiple bifurcations to the first tubes and which extend substantially vertically and parallel to one another between the bottom portion of the case and the middle portion of the case, and bent third tubes which are connected via multiple bifurcations to the second tubes and which extend parallel to one another between the middle portion of the case and the top portion of the case where they are connected to the outlet manifold, the third tubes of the first sheet of tubes and the third tubes of the second sheet of tubes being disposed to form a channel along which the solids can flow, which channel has an O-shaped cross-section, and wherein said first and second sheets of tubes are stiffened at their bottoms by continuous fins disposed between the adjacent tubes.

In a particular embodiment of the invention, the first and second sheets of tubes have different numbers of tubes so that the two sheets of tubes are juxtaposed in said vertical plane along a vertical line that is offset relative to a vertical midline of the case.

In another particular embodiment of the invention, the heat exchanger comprises a first set of first and second sheets of tubes disposed in alternation in parallel vertical planes and connecting the first inlet manifold to the outlet manifold, and a second set of first and second sheets of tubes disposed in alternation in parallel vertical planes and connecting the second inlet manifold to the outlet manifold, the sheets of tubes in the first set of sheets of tubes further being disposed in staggered manner with the sheets of tubes in the second set of sheets of tubes so that a sheet of tubes having a small number of tubes in the first set of sheets of tubes is juxtaposed in the same vertical plane with a sheet of tubes having a larger number of tubes in the second set of sheets of tubes, and a fastening system is further provided for securing together the bottom portions of the sheets of tubes having the larger number of tubes in the two sets of sheets of tubes.

BRIEF DESCRIPTION OF THE DRAWING

An embodiment of the invention is described in more detail with reference to the drawing, in which.

MORE DETAILED DESCRIPTION

Figure 1:
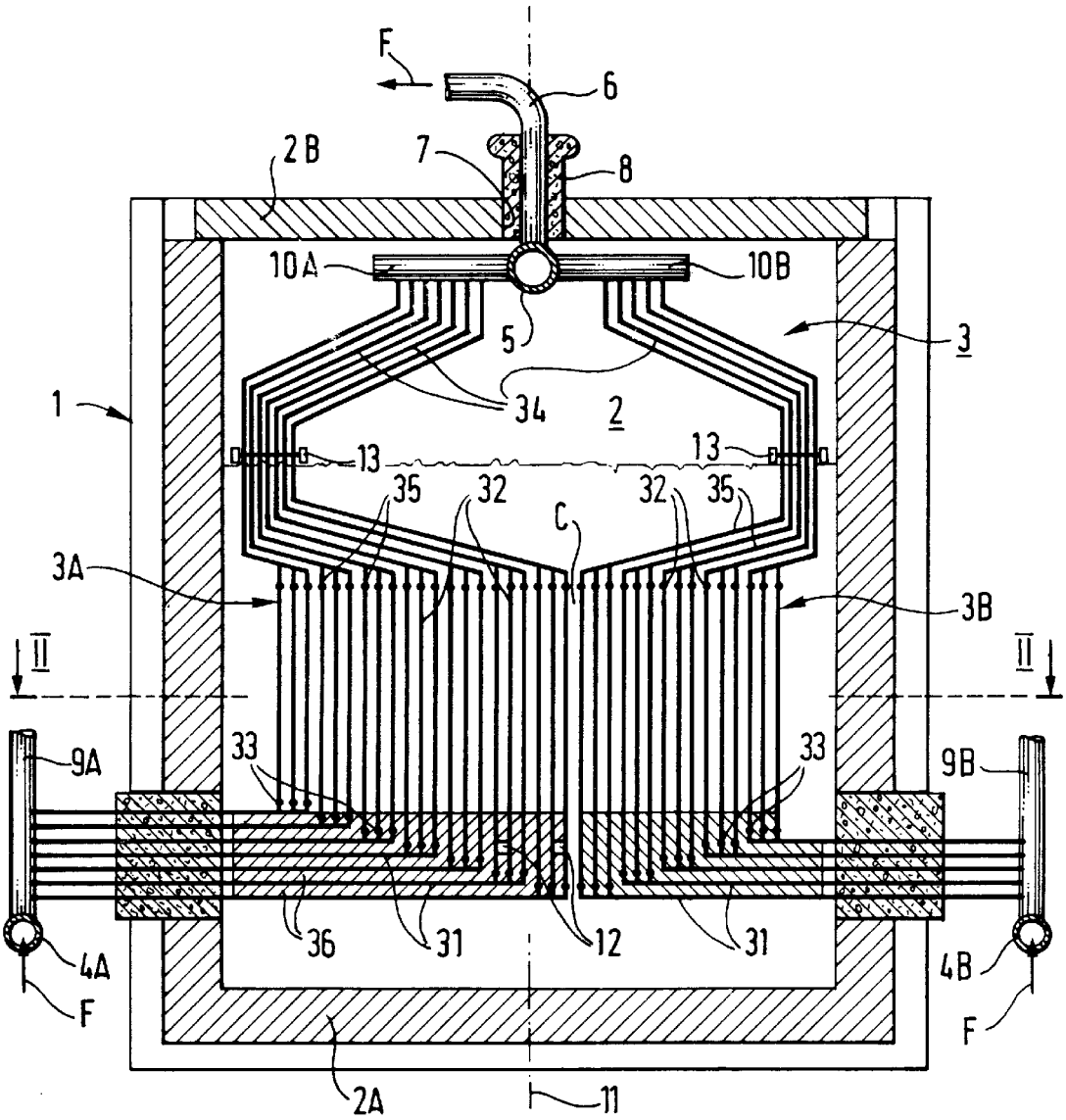
FIG. 1 is a diagrammatic view showing a heat exchanger of the invention as mounted in a fluidized bed.

FIG. 1 is a very diagrammatic cross-section view showing a portion of a dense fluidized bed and more precisely showing a case 1 made of sheet metal reinforced with stiffeners and with an internal layer of concrete, the case defining a chamber 2 into which the solids pour and flow after they have passed over a sill downstream from a chamber for receiving said solids.

The chamber 2 is normally equipped with a bottom box (not shown) for feeding in fluidization air, with fluidization air injection nozzles (not shown) which are disposed in the bottom wall 2A of the chamber 2. A heat exchanger 3 of the invention is shown installed inside the chamber 2.

The heat exchanger 3 comprises a set of tubes serving to convey a coolant, e.g. steam, between two inlet manifolds 4A, 4B for the fluid F disposed at the bottom and on either side of the case and an outlet manifold 5 for the heated fluid, which outlet manifold is disposed at the top and in the center of the case. It is in the chamber 2 that the dense fluidization of the solids takes place, enabling the fluid to be heated in the tubes of the heat exchanger.

Each of the inlet manifolds 4A and 4B is constituted by a tube extending horizontally along the side of the case 1 on the outside thereof, manifold 4A being on the left, and manifold 4B being on the right in FIG. 1.

The outlet manifold 5 is constituted by a tube extending horizontally in the top central portion of the chamber 2, and more precisely under the top wall 2B of the chamber 2. The outlet manifold 5 is connected to a pipe 6 that passes through the top wall 2B via a slot 7. The pipe 6 is coated with concrete 8 that packs the slot 7 so that the outlet manifold 5 is suspended from the top wall 2B of the chamber 2.

The heat exchanger proper 3 comprises a first group of tubes extending in a vertical plane and forming a first sheet 3A of tubes which connect the first inlet manifold 4A to the outlet manifold 5, and a second group of tubes extending in the same vertical plane and forming a second sheet 3B of tubes that connect the second inlet manifold 4B to the outlet manifold 5.

As shown in FIG. 1, each sheet of tubes 3A or 3B includes first tubes such as 31 which extend substantially horizontally and parallel to one another in the bottom portion of the case. The tubes 31 pass through a side wall of the case via a slot packed with concrete, the tubes 31 of the sheet 3A passing through the left wall in FIG. 1 and the tubes 31 of the sheet 3B passing through the right wall in FIG. 1.

Each sheet of tubes 3A, 3B further includes second tubes such as 32 which are connected via multiple bifurcations such as 33 to the first tubes of the sheet in question, and which extend substantially vertically and parallel to one another between the bottom portion of the case and the middle portion of the case.

Each sheet of tubes 3A, 3B further includes third tubes such as 34 bent into C-shapes which are connected via multiple bifurcations such as 35 to the second tubes of the sheet in question, and which extend parallel to one another between the middle portion of the case and the top portion of the case where they are connected to the outlet manifold 5. The bend configuration of the tubes 34 defines the profile of the dense fluidized bed, and more particularly the tubes 34 of the first sheet 3A and of the second sheet 3B form a channel along which the solids flow that has an O-shaped cross-section, which makes it easier for the cross flow of solids to pass through because the solids encounter almost no obstacles.

FIG. 1 shows that the tubes 31 and 32 are relatively close together, and they form a heat exchange area in the bottom of the case that is relatively continuous in the vertical plane while allowing the solids a certain amount of mobility between the adjacent tubes. This configuration thus makes it possible to obtain a heat exchange area that is quite large while the heat exchanger is relatively compact. Although the heat exchanger includes horizontal tubes such as the tubes 31, the coolant flows properly through the heat exchanger by means of the vertical tubes 32 which contribute to ensuring that the natural-flow feed operates properly.

Each sheet of tubes is stiffened in its bottom portion at the level of the tubes 31 and at the bottoms of the tubes 32 by means of continuous fins 36 disposed between adjacent tubes, these fins 36 being shown by hatching in FIG. 1.

In the bottom of the heat exchanger 3, the tubes 31 of the sheet 3A are connected to the inlet manifold 4A via a manifold pipe 9A which extends vertically and the tubes 31 of the sheet 3B are connected to the inlet manifold 4B via another manifold pipe 9B which extends vertically.

In addition, in the top of the heat exchanger 3, the tubes 34 of the sheet 3A are connected to the outlet manifold 5 via a manifold pipe 10A which extends horizontally, and the tubes 34 of the sheet 3B are also connected to the outlet manifold 5 via another manifold pipe 10B which extends horizontally.

The tubes being disposed in the heat exchanger as indicated above makes it possible to design a heat exchanger configuration with a plurality of first and second sheets of tubes so as to increase the heat exchange area without considerably decreasing the compactness of the heat exchanger.

In FIG. 1, the sheets 3A and 3B comprise different numbers of tubes 31 (or 32, 34). In the example shown, sheet 3A has 7 tubes 31 and sheet 3B has 5 tubes 31. In this embodiment, the two sheets 3A and 3B are juxtaposed in the vertical plane along a vertical line at C that is offset relative to a vertical midline 11 of the case. Such a configuration makes it easier to mount a plurality of sheets 3A and 3B in the case.

Figure 2:
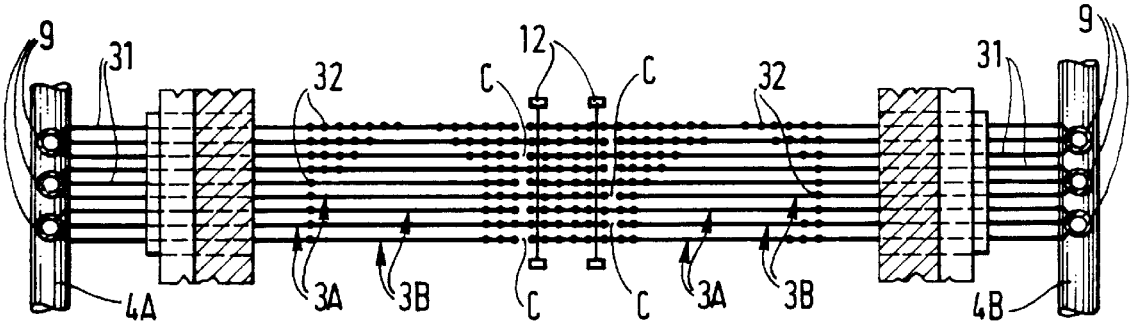
FIG. 2 is a very diagrammatic view in section on II—II of the heat exchanger shown in FIG. 1, as equipped with a plurality of sheets of tubes.

FIG. 2 is a very diagrammatic view in section on II—II of the case shown in FIG. 1, showing one configuration of a heat exchanger of the invention comprising a plurality of sheets 3A and 3B. It can be seen that a plurality of sheets 3A and 3B are interposed in the longitudinal direction of the case.

More particularly, this configuration includes a first set of sheets of tubes 3A and 3B disposed on the left in FIG. 2 in alternation (i.e. one sheet 3A and one sheet 3B alternately) in parallel vertical planes. The first set of sheets of tubes 3A, 3B connects the inlet manifold 4A to the outlet manifold 5. The configuration includes a second set of sheets of tubes 3A and 3B disposed on the right in FIG. 2 in alternation in parallel vertical planes. The second set of sheets of tubes 3A, 3B connects the second inlet manifold 4B to the outlet manifold 5.

As shown in FIG. 2, the sheets 3A, 3B of the first set of sheets are disposed in staggered manner with the sheets 3A, 3B of the second set of sheets, so that a sheet of tubes that has a small number of tubes in the first set, i.e. a sheet 3B, is juxtaposed in the same vertical plane with a sheet of tubes that has a larger number of tubes in the second set, i.e. a sheet 3A. The sheets 3A and 3B of the of the two sets of sheets of tubes are thus interleaved in one another.

This staggered configuration of the sheets 3A and 3B makes it easier to mount them in the case. In addition, a fastening system is provided to secure together the bottom portions of the sheets of tubes having the larger number of tubes in the two sets of sheets of tubes, i.e. the sheets 3A, so as to make the structure of the heat exchanger rigid in the vertical direction while allowing the sheets the possibility of moving relative to one another in the horizontal direction. This fastening system is represented by way of example in FIG. 2 by two rods 12 which pass through fins 36 disposed in the bottom portions of the sheets. The two rods 12 are also shown in FIG. 1.

By way of non-limiting example, FIG. 2 shows a heat exchanger structure of the invention, in which 3 sheets 3A or 3B of a set of sheets as defined above are connected to a pipe 9 welded to an inlet manifold, respectively 4A or 4B, the pipe 9 securing the sheets 3A or 3B together at their bottoms.

FIG. 2 also shows a heat exchanger configuration of the invention including a plurality of pipes such as 9 and thus a plurality of triplets of sheets 3A or 3B of a set, disposed in adjacent vertical planes. It can be understood that it is easy to increase the heat exchange area by increasing the number of pipes 9, and thus the number of sheets of tubes.

To stiffen the sheets connected to the same tube such as 9 at their tops, an additional clamp such as 13 (shown in FIG. 1) is provided at the level of the tubes 34.

Since the pipes such as 10A and 10B are also welded to the outlet 5, the heat exchanger of the invention is self-supporting.

I claim:

1. A heat exchanger for a dense fluidized bed, said heat exchanger comprising at least one first group of tubes extending in a vertical plane and forming a first sheet of tubes for connecting a first inlet fluid manifold disposed at the bottom and on one side of a case to an outlet manifold disposed in a central top portion of the case, and at least one second group of tubes extending in said vertical plane and forming a second sheet of tubes for connecting a second inlet fluid manifold disposed at the bottom and on one side of the case to the outlet manifold, wherein each of the first and second sheets of tubes comprises first tubes which extend substantially horizontally and parallel to one another in the bottom portion of the case, second tubes which are connected via multiple bifurcations to the first tubes and which extend substantially vertically and parallel to one another between the bottom portion of the case and the middle portion of the case, and bent third tubes which are connected via multiple bifurcations to the second tubes and which extend parallel to one another between the middle portion of the case and the top portion of the case where they are connected to the outlet manifold, the third tubes of the first sheet of tubes and the third tubes of the second sheet of tubes being disposed to form a channel along which the solids can flow, which channel has an O-shaped cross-section, and wherein said first and second sheets of tubes are stiffened at their bottoms by continuous fins disposed between the adjacent tubes.

2. A heat exchanger according to claim 1, in which the first and second sheets of tubes have different numbers of tubes so that the two sheets of tubes are juxtaposed in said vertical plane along a vertical line that is offset relative to a vertical midline of the case.

3. A heat exchanger according to claim 2, comprising a first set of first and second sheets of tubes disposed in alternation in parallel vertical planes and connecting the first inlet manifold to the outlet manifold, and a second set of first and second sheets of tubes disposed in alternation in parallel vertical planes and connecting the second inlet manifold to the outlet manifold, the sheets of tubes in the first set of sheets of tubes further being disposed in staggered manner with the sheets of tubes in the second set of sheets of tubes so that a sheet of tubes having a small number of tubes in the first set of sheets of tubes is juxtaposed in the same vertical plane with a sheet of tubes having a larger number of tubes in the second set of sheets of tubes, and in which heat exchanger a fastening system is provided for securing together the bottom portions of the sheets of tubes having the larger number of tubes in the two sets of sheets of tubes.

* * * * *